US005189648A

United States Patent [19]

Cooper et al.

[11] Patent Number: 5,189,648

[45] Date of Patent: Feb. 23, 1993

[54] ALARM CLOCK GAME COMBINATION

[75] Inventors: Stephen B. Cooper, Norman, Okla.; Scott R. Downie, Kansas City, Kans.

[73] Assignee: Stephen B. Cooper, Norman, Okla.

[21] Appl. No.: 728,402

[22] Filed: Jul. 11, 1991

[51] Int. Cl.[5] ..... G04B 23/02; G04C 21/00

[52] U.S. Cl. ..... 368/73; 368/262

[58] Field of Search ..... 368/10, 72-74, 368/250, 251, 262, 263

[56] References Cited

U.S. PATENT DOCUMENTS

| | | | |
|---|---|---|---|
| 4,316,273 | 2/1982 | Jetter | 368/47 |
| 4,352,170 | 9/1982 | Jetter | 368/73 |
| 4,430,006 | 2/1984 | Jetter | 368/73 |

*Primary Examiner*—Vit W. Miska

*Attorney, Agent, or Firm*—Dunlap, Codding & Lee

[57] ABSTRACT

A game-alarm clock including an electronic clock, an alarm and an electronic game. The electronic game is connected between the electronic clock and the alarm whereby an individual must successfully play the electronic game in order to prevent the alarm from sounding or to turn the alarm sound off.

6 Claims, 1 Drawing Sheet

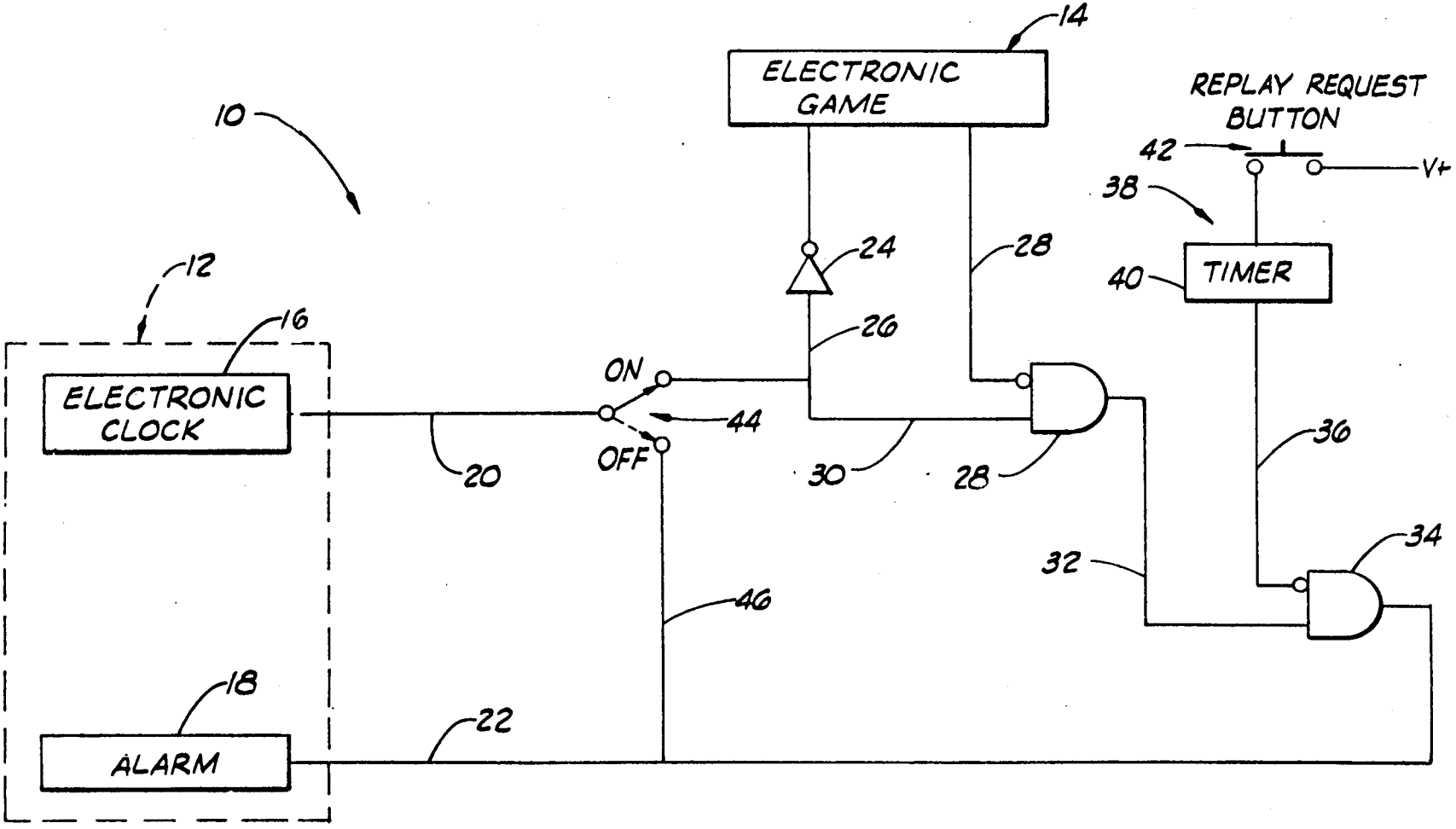
REPLAY REQUEST BUTTON
V+
TIMER
ELECTRONIC GAME
ON
OFF
ELECTRONIC CLOCK
ALARM
10
12
14
16
18
20
22
24
26
28
28
30
32
34
36
38
40
42
44
46

ALARM CLOCK GAME COMBINATION

FIELD OF THE INVENTION

The present invention relates to an electronic clock, an alarm and an electronic game interconnected such that an individual is required to successfully complete the game of the electronic game to terminate the alarm sound or to prevent the alarm from sounding.

BRIEF DESCRIPTION OF THE DRAWINGS

The single FIGURE of drawings is a schematic, diagrammatic view of the game-alarm clock of the present invention.

DESCRIPTION OF THE PREFERRED EMBODIMENTS

It is common for individuals to set an alarm clock for a certain time and, when the alarm sounds, the individual merely turns the alarm off and goes back to sleep. In many instances, the individual turns the alarm off while still in a sleep or semi-sleep state which increases the likelihood that th individual will go back to sleep, rather than wake-up.

The present invention provides a wake-up alarm which requires the individual to behave in a manner which will more likely cause the individual to achieve a wake or cognitive state, thereby fulfilling as efficiently as possible the real objective of the alarm clock, that is, to cause the individual to wake-up. The present invention provides visual and auditory stimuli combined with thought or mental activity sufficient to cause the individual to achieve the wake or cognitive state, thereby enhancing the possibility that the individual actually will wake-up, rather than go back to sleep.

Shown in the single figure of drawings is a game-alarm clock constructed in accordance with the present invention and designated by the reference numeral 10. The game-alarm clock 10 basically consists of an electronic alarm clock 12 and an electronic game 14. The electronic alarm clock 12 includes an electronic clock 16 and an alarm 18. The electronic game 14 is connected to the electronic alarm clock 12 in such a manner that an individual must successfully complete the electronic game in order to terminate the alarm sound outputted by the electronic alarm clock 12 or to prevent the initiation of the alarm sound outputted by the electronic alarm clock 12.

The electronic clock 16 is adapted to measure time and output the measured time in a human-perceivable format such as by way of a digital format. The electronic clock 16 is settable by an individual at a selected alarm time. The electronic clock 16 measures time and compares the measured time with the preset alarm time. The electronic clock 16 outputs an electronic alarm signal in response to the measured time being equal to the alarm time. More particularly, the electronic clock 16 outputs the electronic alarm signal on a signal path 20 in a HIGH state in response to the measured time being equal to the alarm time. The electronic clock 16 outputs a no alarm signal on the signal path 20 in response to the measured time not being equal to the alarm time in a LOW state.

The alarm 18 is constructed and adapted to receive the electronic alarm signal or electronic no alarm signal outputted by the electronic clock on a signal path 22. The alarm 18 is adapted to output an audibly perceivable alarm sound in one mode in response to receiving an electronic alarm signal on the signal path 22 in the HIGH state. The alarm 18 is adapted to terminate or not initiate the alarm sound in one other mode in response to receiving the electronic no alarm signal on the signal path 22 outputted by the electronic clock 16.

Electronic alarm clocks with electronic clocks and alarms constructed and operated like the electronic alarm clock 12 with the electronic clock 16 and the alarm 18 described before are well known in the art and commercially available, such as the electronic alarm clock sold by SONY, Model No. 1CFC120. Therefore, a detailed description of the construction and operation of such electronic alarm clocks is not deemed necessary herein.

The signal on the signal path 20 is inputted through a inverter 24 interposed in a signal path 26 into the electronic game 14. In the HIGH state of the signal inputted into the electronic game 14, the electronic game 14 is reset to output a game lost signal in the LOW state on a signal path 28. In the LOW state of the signal inputted into the electronic game 14, the electronic game 14 is adapted to not change the signal outputted by the electronic game 14 on the signal path 28 or, in other words, a signal in the LOW state inputted into the electronic game 14 results in a no-change condition. The electronic game 14 is adapted to output a game won signal in the HIGH state in response to an individual's successfully completing or playing the electronic game.

The electronic game 14 is adapted to provide a game for playing by an individual having a won or lost result. The electronic game 14 requires the individual to manually activate portions of the electronic game 14 as the game is played, such as depressing buttons or keys on the electronic game. The electronic game 14 has game parameters (requirements for winning) and the game won signal is outputted by the electronic game 14 in response to the individual satisfying those game parameters. The electronic game 14 preferably requires the individual to manually activate portions of the electronic game 14, such as by depressing buttons in a predetermined pattern and the electronic game 14 outputs the game won signal in response to the individual activating the portions of the electronic game in the predetermined pattern. The electronic game 14 thus preferably requires mental activity on the part of the individual playing the game and hand-eye coordination on the part of the individual as the game is played.

There are numerous electronic games which are commercially available. The present invention contemplates either the use of one of the commercially available electronic games or any other electronic game similarly constructed. One such electronic game which is commercially available, for example, is an electronic game sold by Radio Shack (Tandy Corporation) under the mark "Pocket Repeat". With this game, lights are associated with buttons and the lights light in a random sequence requiring the individual to depress the buttons corresponding to each light as it is lit in order to successfully complete the game. The electronic game 14 may be this type of electronic game.

It is contemplated that, when the electronic game is battery-operated, a switch (not shown) would be interposed between the battery power supply and the other components of the game which would be closed in response to the electronic game 14 receiving a signal in the LOW state. In one other form, the electronic game 14 could simply be left in the on condition thereby maintaining the connection between the battery power supply and the other components of the game at all times; however, this mode of operation would simply result in the battery being drained in a shorter period of time. In a preferred form, the power supply for the electronic clock 16 also is used as the power supply for electronic game 14 power supply thereby eliminating the concerns just described.

The signal outputted by the electronic game 14 on the signal path 28 is inputted into an inverted input of an AND gate 28. The AND gate 28 also receives the signal outputted by the electronic clock on the signal path 20 by way of a signal path 30. The AND gate 28 is adapted to output a signal on a signal path 32 in the HIGH state in response to receiving inputs on the signal paths 28 and 30 both of which are in the HIGH state. If the signal on the signal path 28 or 30 inputted into the AND gate 28 is in the LOW state, the AND gate 28 will output a signal in the LOW state on the signal path 32.

The signal outputted by the AND gate 28 on the signal path 32 is received by an AND gate 34. The AND gate 34 also receives a signal on a signal path 36 which is inputted into an inverting input of the AND gate 34.

A replay assembly 38 is interposed between the electronic game 14 and the alarm 18. The replay assembly 38 receives the electronic game lost signal and the electronic game won signal and delays the causing of the alarm 18 outputting the alarm sound for a predetermined period of time in response to receiving the game lost signal. More particularly, the replay assembly 38 includes a timer 40 which is adapted to output a LOW signal on the signal path 36 in response to a predetermined time expiring and to output a HIGH signal on the signal path 36 in response to the timer 40 running condition. The timer 40 is constructed and adapted so that the time of the timer can be set at any predetermined time at the option of the individual user. Timers which are constructed and which operate in a manner described before with respect to the timer 40 are commercially available and a detailed description of the construction and operation of such timers is not deemed necessary herein.

The timer 40 is connected to the power supply (designated V+ in the drawing) by way of a replay request button 42. When the replay request button 42 is depressed, the power supply is connected to the timer 40 and the timer 40 begins counting down the predetermined time inputted into the counter by the individual. The timer 40 outputs a HIGH signal on the signal path 36 in response to the counter counting down the preset time and the timer 40 outputs a LOW signal on the signal path 36 when the time has been counted down by the timer 40.

The AND gate 34 is adapted to output the electronic alarm signal or the electronic no alarm signal on the signal path 22. More particularly, in response to receiving two inputs in the HIGH condition, the AND gate 34 outputs a signal on the signal path 22 in the HIGH state. If either inputs on the signal path 32 or 36 as in the LOW state, the AND gate 34 outputs a signal in the LOW state.

A switch 44 is interposed between the electronic clock 16, the electronic game 14 and the alarm 18. In a game mode, the switch 44 is positioned as shown in the drawing for connecting the electronic clock 16 to the electronic game 14. In a clock mode, the switch 44 is positioned as shown in dashed-lines in the drawing to connect the electronic clock 16 directly to the alarm 18.

Assuming the switch 44 is positioned in the clock mode as shown in dashed lines in the drawing, the electronic clock 16 outputs an electronic no alarm signal in the LOW state in response to the measured time not being equal to the alarm time. The outputted electronic no alarm signal is connected to the alarm 18 by way of the signal path 20, the switch 44, a signal path 46 and the signal path 22. In response to receiving the electronic no alarm signal in the LOW state, the alarm 18 is conditioned to not output the audibly perceivable alarm sound. By the same token, when the electronic clock 16 outputs the electronic alarm signal in response to the measured time being equal to the alarm time, the electronic alarm signal in the HIGH state is received by the alarm 18 and the alarm 18 outputs the audibly perceivable alarm sound in response thereto.

In the game mode, the switch 44 is positioned as shown in the drawing to connect the electronic clock 16 to the electronic game 14.

In the game mode and assuming the electronic clock 16 is outputting the electronic no alarm signal in the LOW state on the signal path 20 in response to the measured time not being equal to the alarm time, the electronic no alarm signal in the LOW state is inputted into the electronic game 14 by way of the inverter 24. The inverter 24 inverts the electronic no alarm signal in the LOW state to a signal in the HIGH state which is inputted into the electronic game 14. In response to receiving the signal in the HIGH state, the electronic game 14 is conditioned to be reset and output a signal in the LOW state (a game lost signal) over the signal path 28. Thus, the AND gate 28 receives a signal in the HIGH state by way of the inverted input connected to the signal path 28 and the AND gate 28 receives a signal in the LOW state (the electronic no alarm signal) over the signal path 30. In response, the AND gate 28 outputs a signal on the signal path 32 in the LOW state.

The signal in the LOW state on the signal path 32 is received by the AND gate 34. Assuming the timer 40 is not running, the AND gate receives the signal in the HIGH state on the signal path 36 by way of the inverted input of the AND gate 34. In response, the AND gate outputs a signal in the LOW state (the electronic no alarm signal) over the signal path 22. In response to receiving the electronic no alarm signal on the signal path 22, the alarm 18 is conditioned to not provide the audibly perceivable alarm sound.

Assuming the measured time equals the alarm time and in the game mode, the electronic clock 16 is conditioned to output the electronic alarm signal in the HIGH state on the signal path 20 when the measured time equals the alarm time. The electronic alarm signal in the HIGH state is connected to the electronic game 14 by way of the inverter 24 which causes a signal in the LOW state to be inputted into the electronic game 14. In response to receiving the signal in the LOW state over the signal path 26 by way of the inverter 24, the electronic game 14 is conditioned so that there is no change in the output state of the signal path 28, the signal being in the LOW state.

In this condition, the AND gate 28 receives the electronic alarm signal in the HIGH state on the signal path 30 and receives a signal in the HIGH state by way of the signal path 28 and the inverted input to the AND gate 28. In response, the AND gate 28 outputs a signal in the HIGH state over the signal path 32. Assuming the timer 40 is not running, the AND gate 34 also receives a signal in the HIGH state by way of the signal path 36 in the inverted input to the AND gate 34. In response, the AND gate 34 outputs the electronic alarm signal in the HIGH state over the signal path 22. In response to receiving the electronic alarm signal in the HIGH state, the alarm 18 is conditioned to output the audibly perceivable alarm sound.

In this condition, the alarm 18 will continue to output the audibly perceivable alarm sound until the state of the signal on the signal path 22 inputted into the alarm 1B is changed to a LOW state.

In one form, the alarm 18 will continue to output the audibly perceivable alarm sound until the individual successfully plays the game provided by the electronic game 14. When the individual successfully completes or plays the game provided by the electronic game 14, the electronic game 14 will output a game won signal on the signal path 28 in the HIGH state and a signal in the LOW state will be inputted into the AND gate 28 by way of the inverted input connected to the signal path 28. This will cause the AND gate 28 to output a signal in the LOW state on the signal path 32. In this condition, the AND gate 34 will receive a signal in the LOW state on the signal path 32 and, assuming the timer 40 is not running, the AND gate 34 will receive a HIGH signal by way of the signal path 36 in the inverted input to the AND gate 34. In response, the AND gate will output the electronic no alarm signal in the LOW state over the signal path 22. In response to receiving the electronic no alarm signal on the signal path 22, the alarm 18 is conditioned to terminate the outputting of the audibly perceivable alarm sound.

Thus, the alarm 18 will continue to output the audibly perceivable alarm sound until the individual has successfully completed the electronic game 14 resulting in the electronic game 14 outputting the game won signal in this mode of operation.

In the alternative, when the electronic clock 16 outputs the electronic alarm signal in the HIGH state, thereby resulting in the outputting of the audibly perceivable alarm sound by the alarm 18, the individual can terminate the outputting of the audibly perceivable alarm sound by the alarm 18 by depressing the replay request button 42. When the individual depresses the replay request button 42, the countdown of the timer 40 is initiated and the timer 40 outputs a HIGH signal on the signal path 36. This results in a LOW signal being inputted to the AND gate 34 over the signal path 36 by way of the inverted input to the AND gate 34. In this condition, the AND gate 34 will output the electronic no alarm signal in the LOW state on the signal path 22 thereby causing the alarm 18 to terminate the outputting of the audibly perceivable alarm sound.

The alarm 18 will continue to receive the electronic no alarm signal in the LOW state thereby delaying the outputting of the alarm sound by the alarm 18 as long as the timer 40 is running or counting down the preset time.

If the timer 40 counts down the preset time and the individual still has not successfully completed the electronic game 14, the timer 40 will output a signal in the LOW state on the signal path 36 resulting in a signal in the HIGH state being inputted into the AND gate 34 by way of the signal path 36 in the inverted input to the AND gate 34. In this condition, the AND gate 34 will output the electronic alarm signal on the signal path 22 thereby causing the alarm 18 to again output the audibly perceivable alarm sound.

On the other hand, if the individual successfully completes the electronic game 14 resulting in the electronic game 14 outputting the game won signal in the HIGH state, a signal in the LOW state will be outputted by the AND gate 28 over the signal path 32. In this condition, the AND gate 34 will output the electronic no alarm signal on the signal path 20 resulting in the termination of the outputting of th audibly perceivable alarm sound by way of the alarm 18, regardless of whether the timer 40 still is running or counting down or the time has been counted down or expired.

In the game mode and assuming that the electronic alarm clock 16 has outputted the electronic alarm signal, the alarm 18 will be conditioned to output the audibly perceivable alarm sound until either the individual has successfully completed the electronic game 14 or the individual has depressed the replay request button 42. The depressing of the replay request button 42 delays the outputting of the audibly perceivable alarm sound by the alarm 18 to terminate for the period of time preset into the timer 40. This allows the individual this preset period of time during which the individual must complete successfully the game provided by the electronic game 14. Otherwise, the alarm 18 will again start outputting the audibly perceivable alarm sound until the individual again depresses the replay request button 42 to provide the individual an additional preset time during which the individual must successfully complete the game 14 in order to prevent the alarm 18 from outputting the audibly perceivable alarm sound. The timer 40 can be adjusted for different time periods as a skill variance with more skillful players requiring less time during which to successfully complete the game provided by the electronic game 14.

Changes may be made in the construction and the operation of the assemblies, components and elements of the game-alarm clock described herein without departing from the spirit and the scope of the invention as defined in the following claims.

What is claimed is:

1. A game-alarm clock comprising:

electronic clock means for measuring time (measured time) and being settable at an alarm time for outputting an electronic alarm signal in response to the measured time being equal to the alarm time, the electronic alarm clock means outputting an electronic no alarm signal in response to the measured time not being equal to the alarm time;

alarm means for outputting an audibly perceivable alarm sound in one mode and for terminating the alarm sound in one other mode;

electronic game means for providing a game for playing by an individual and receiving the electronic alarm signal and for outputting an electronic game lost signal and for outputting an electronic game won signal in response to the individual winning the game; and means for receiving the electronic game lost signal and the electronic game won signal from the electronic game means and for causing the alarm means to output the audibly preceivable alarm sound in response to receiving the electronic game lost signal and the electronic alarm signal in one mode of operation, and for causing the terminating of the audibly perceivable alarm sound in response to receiving the electronic game won signal and the electronic alarm signal or in response to receiving the electronic no alarm signal and either the electronic game won signal or the electronic game lost signals, said means including means for delaying the alarm means outputting the alarm sound for a predetermined period of time when said means is receiving the electronic game lost signal and the electronic alarm signal in one other mode of operation.

2. The game-alarm clock of claim 1 further comprising:

means interposed between the electronic clock means, the electronic game means and the alarm means for connecting the electronic alarm signal to the electronic game means in a game mode and for connecting the electronic alarm signal to the alarm means in a clock mode, the alarm means receiving the electronic alarm signal from the electronic clock means in the clock mode for causing the outputting of the audibly perceivable alarm sound.

3. The game-alarm clock of claim 1 wherein the electronic game means is defined further as requiring the individual to manually activate portions of the electronic game means as a portion of the game.

4. The game-alarm clock of claim 1 wherein the electronic game means is defined further as having game parameters and outputting the electronic game won signal in response to the individual satisfying the game parameters.

5. The game-alarm clock of claim 1 wherein the electronic game means is defined further as requiring the individual to manually activate portions of the electronic game means in a predetermined pattern and outputting the electronic game won signal in response to the individual manually activating the portions of the electronic game means in the predetermined pattern.

6. The game-alarm clock of claim 1 wherein the electronic game means is defined further as requiring mental activity and hand-eye coordination as part of the game.

* * * * *